United States Patent [19]

Hull

[11] 4,183,331

[45] Jan. 15, 1980

[54] FORCED CIRCULATION STEAM GENERATOR

[76] Inventor: Francis R. Hull, 567 E. 26th St., New York, N.Y. 11210

[21] Appl. No.: 877,034

[22] Filed: Feb. 10, 1978

Related U.S. Application Data

[60] Continuation-in-part of Ser. No. 651,776, Jan. 23, 1976, abandoned, which is a division of Ser. No. 469,475, May 13, 1974, Pat. No. 3,934,799, which is a continuation-in-part of Ser. No. 284,166, Aug. 23, 1972, abandoned.

[51] Int. Cl.[2] ..... F22D 1/28

[52] U.S. Cl. ..... 122/442; 122/407

[58] Field of Search ..... 237/9 R, 67; 122/31, 122/407, 441, 442, 31 R

[56] References Cited

U.S. PATENT DOCUMENTS

| | | | |
|---|---|---|---|
| 2,515,647 | 7/1950 | Hunt et al. | 237/9 |
| 3,934,799 | 1/1976 | Hull | 122/442 |

FOREIGN PATENT DOCUMENTS

| | | | |
|---|---|---|---|
| 1255782 | 12/1971 | United Kingdom | 122/407 |

*Primary Examiner*—William E. Wayner
*Assistant Examiner*—Henry Bennett

[57] ABSTRACT

Forced circulation steam generators of any design may increase effective heat absorption and steaming capacity by maintaining bulk boiler water temperature at or near the saturation temperature for the operating pressure, while the main boiler heat transfer process is substantially reserved for the evaporative function. The acceleration of gas-to-liquid energy transfer across boiler heating surfaces occurs when bulk boiler water temperature is maintained at or near saturation, and significant degrees of nucleate boiling and nucleate film boiling heat transfer exist while stable steam film boiling is limited.

In one form of the invention, recirculating boiler water is discharged from a circulating pump through an exterior ejector-type contact heat exchanger to mix with recirculated heating steam before being returned to the boiler. In this adaptation bulk boiler water temperature may be closely controlled by regulating the quantity of heating steam admitted into the ejector heat exchanger.

In another form of the invention, recirculated boiler water is discharged from a circulating pump through an ejector-type contact heat exchanger which is mounted internally within the boiler steam spaces, where it mixes with heating steam before being returned to the bulk boiler water body at or near the saturation temperature. In this variation the ejector heat exchanger discharge is automatically kept at or near the saturation temperature, and no valve regulating means is required to control the quantity of heating steam.

7 Claims, 2 Drawing Figures

FORCED CIRCULATION STEAM GENERATOR

Figure 1:
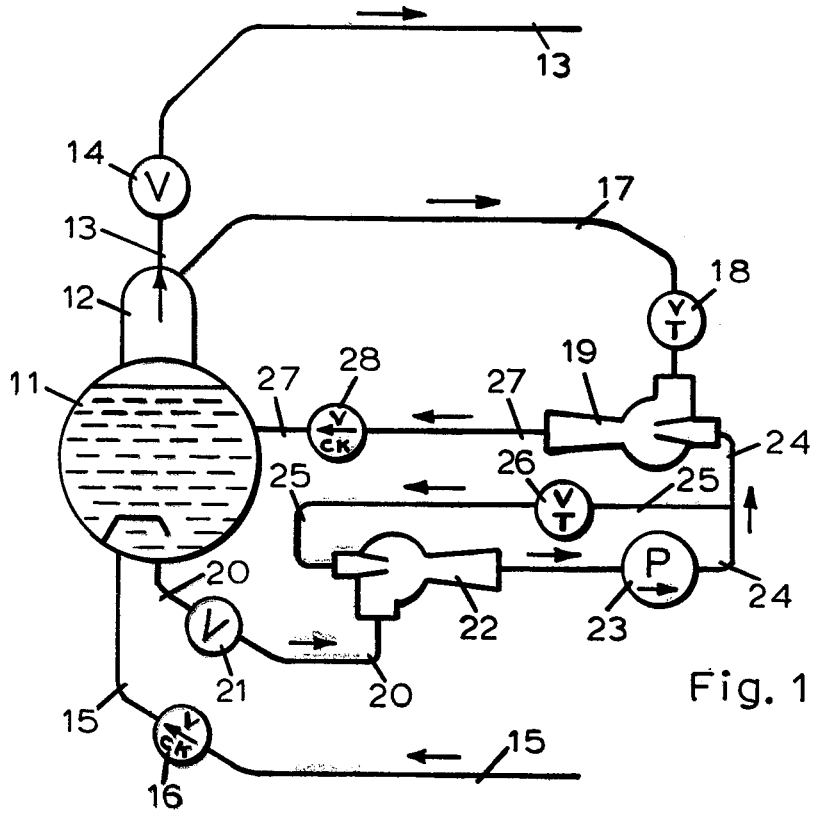

The present invention is a continuation-in-part of my application Ser. No. 651,776 entitled "Forced Circulation Steam Generator" filed Jan. 23, 1976 (now abandoned); which was a division of my patent application Ser. No. 469,475 entitled "High-Capacity Steam Heating System" filed May 13, 1974 (now U.S. Pat. No. 3,934,799 Jan. 27, 1976); which was a continuation in part of my patent application Ser. No. 284,166 entitled "High-Capacity Steam Heating System" filed Aug. 23, 1972 (now abandoned); and to predecessor applications thereof.

As used hereinafter, the term "fluid" shall relate to any liquid or gaseous medium;

the term "contact heating" shall refer to the preheating of recirculated boiler water by mixing with recirculated heating steam within a velocity-accelerated contact heat exchanger before the boiler water is evaporated;

the term "contact interchange" shall refer to the fluid-to-fluid exchange of thermal and kinetic energy between adjacent fluid streams having different velocities in parallel flow, and having no physical or mechanical separation between them;

the term "characteristic length" shall relate to the effective linear dimension parallel to the direction of mean fluid flow within which contact interchange takes place between a heating fluid stream and a cooling fluid stream; and the term "mixing length" shall relate to the effective linear dimension perpendicular to the direction of mean fluid flow within which contact interchange shall take place between a heating fluid stream and a cooling fluid stream.

While the apparatus of the invention is described in connection with the forced circulation of boiler water through contact heat exchangers for temperature maintenance which is separate from the evaporative heat transfer process of the steam generator, it will be understood by those skilled in the art that variations of the forced circulation steam heating process described hereinafter which use related velocity-accelerated contact heat exchange methods may be employed advantageously in other configurations and arrangements without departing from the scope of the invention.

The primary object of the invention is to provide means for lowering boiler stack temperatures by increasing heat absorption.

A major object is to provide controllable means for maintaining bulk boiler water at or near saturation temperature for the operating pressure, which is separate from the evaporative heat transfer process of the boiler.

Another important object is to provide means for accelerating boiler heat absorption which also increases steaming capacity.

A further object is to separate the sensible boiler water heating process from the latent boiler water evaporating process, and reserve the main boiler heating surface for the evaporative function.

With the foregoing objects in view, together with others that may appear as the description proceeds, the invention resides in the novel assemblage and arrangement of system components for forced circulation steam generators which will be described more fully in the discussion, illustrated in the drawings, and particularly pointed out in the claims.

In the drawing:

FIG. 1 is a schematic process diagram of a forced circulation steam generator wherein boiler water is recirculated through an exterior water-jet ejector-type contact heat exchanger and mixed with recirculated heating steam before re-entering the boiler. The recirculation piping system includes a circulating pump 23, a booster eductor (or ejector) 22 actuated by the pump discharge which increases pump suction pressure, and an ejector-type contact heat exchanger 19 for mixing recirculated boiler steam and boiler water.

Figure 2:
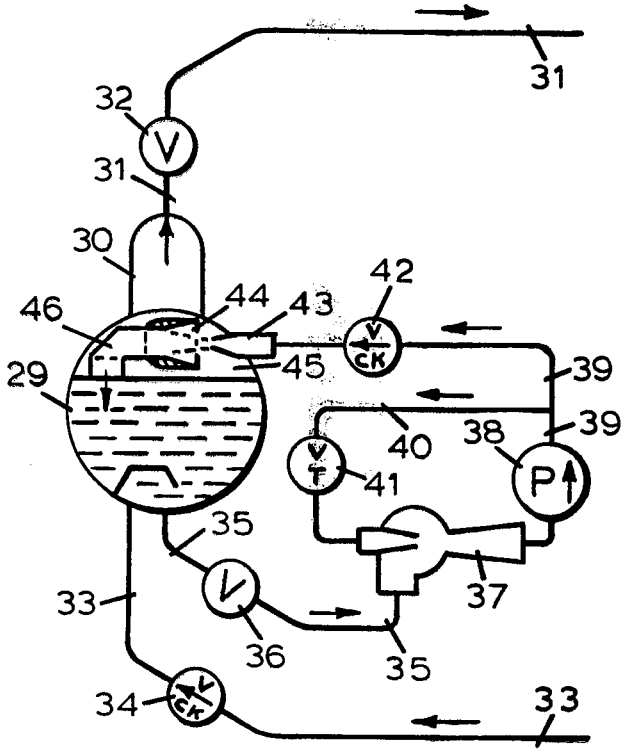

FIG. 2 is a schematic process diagram of a forced circulation steam generator wherein boiler water is recirculated through a water-jet ejector-type contact heat exchanger which is mounted internally within the boiler steam spaces, where the water mixes freely with heating steam before returning to the bulk boiler water body. The recirculation piping system includes a circulating pump 38, a booster eductor (or ejector) 37 actuated by the pump discharge which increases pump suction pressure, and an internal ejector-type contact heat exchanger 43–44 for mixing recirculated boiler water with boiler steam.

Application of velocity-accelerated contact interchange to temperature control of circulating boiler water by mixing with recirculating heating steam includes the following conditions:

(1) Conversion of circulating pump water pressure energy to maximum kinetic energy within a nozzle passage of the contact heat exchanger.

(2) Introduction of regulated heating steam into the receiving section of the contact heat exchanger.

(3) Bringing the high-velocity boiler water stream and the heating steam fluid stream into physical contact at substantially equal pressure within the mixing section of the heat exchanger while in parallel flow (traveling in the same direction) with respect to each other. The object at this stage is to divide flow within the mixing section of the heat exchanger into fluid laminae having greatly different momenta.

(4) The large difference in velocity between the fluid streams accelerates energy transfer between them. Momentum is substantially transferred over an effective mixing length, and accelerates the transfer of thermal energy from the heating steam over a characteristic length within the receiving section of the heat exchanger.

(5) The mixture of entrained and condensed heating steam together with the heated boiler water is guided to a minimum-velocity, maximum-pressure state by flowing through a diffuser passage of the heat exchanger.

(6) The combined fluid streams are discharged from the contact heat exchanger and returned to the steam generator.

In FIG. 1 pressurized steam flows from steam outlet 12 of forced circulation steam generator or boiler member 11 into main steam header 13 through valve 14, and thence to thermodynamic processes served by the steam generator. During operations feedwater or condensate enters steam generator 11 by way of feed or return line 15 and check valve 16. Heat transfer surfaces of forced circulation steam generator 11 are substantially reserved for evaporative heat transfer, as circulating boiler water is substantially maintained at or near the saturation temperature by contact mixing with recirculated heating steam within ejector contact heat exchanger 19 of auxiliary circulating and heating system 17-28 inclusive. It should be noted that steam generator 11, outlet 12, and contact circulation heating elements 17-28 could be assembled together by a maufacturer as a complete forced circulating boiler system and supplied to a user for varied steam heating, steam process, and steam power generating applications.

Circulating pump 23 takes suction from the water body of steam generator 11 through water-jet ejector or eductor 22, circulating line 20 and valve 21. Circulating pump 23 receives lightly pressurized boiler water from the discharge of eductor 22, which in turn takes suction from boiler circulating outlet line 20. Eductor 22 is actuated by the recirculation of a minor fraction of the high-pressure output of circulating pump 23, supplied to the motive nozzle of eductor 22 through recirculation line 25 and throttle valve 26. Operation of throttle valve 26 controls the motive flow of recirculating feedwater to eductor 22, and in turn controls the supply pressure to the suction of circulating pump 23. It should be understood that water-jet ejector or eductor 22 acts as a low-pressure booster pump for its companion circulating pump 23, and prevents the onset of cavitation within circulating pump 23.

The major fraction of the high-pressure output of circulating pump 23 flows from discharge line 24 to the motive nozzle of water-jet ejector contact heat exchanger 19. Ejector contact heat exchanger 19 takes suction from steam supply branch 17 through throttle valve 18. Adjustment of throttle valve 18 regulates the quantity of recirculating heating steam admitted into ejector heat exchanger 19 for contact mixing with recirculating boiler water. The mixture of entrained and condensed steam together with the recirculated boiler water flows from the diffuser section of ejector contact heat exchanger 19 into discharge line 27 through check valve 28, and flows thence into steam generator member 11.

Pressurized boiler water is returned to steam generator 11 via circulating discharge line 27. In a water-tube boiler of any design the pressurized boiler water would normally be distributed through a plurality of small-diameter evaporating tubes at the required mass velocity. In a fire-tube boiler the pressurized boiler water would normally be reintroduced into the boiler shell at an end opposite the boiler circulating outlet, and may flow again towards the circulating outlet through a series of baffles in a cross-flow configuration which is common to the heat exchanger arts.

In FIG. 2 pressurized steam flows from steam outlet 30 of forced circulation steam generator or boiler member 29 into main steam header 31 through valve 32, and thence to processes served by the steam generator. Feedwater or condensate enters steam generator 29 by way of feed or return line 33 and check valve 34. The forced circulation steam generation system of FIG. 2 functions similarly to that of FIG. 1, excepting that ejector-type contact heat exchanger 43-44 inclusive is disposed internally within steam space 45 of boiler member 29.

Circulating pump 38 takes suction from the bulk water body of steam generator 29 through water-jet ejector or eductor 37, circulating line 35 and valve 36. Eductor 37 lightly pressurizes the suction of pump 38, and is actuated by a minor pump discharge fraction through supply branch 40 and throttle valve 41. The major fraction of the high-pressure output of circulating pump 38 is supplied to internal motive nozzle 43 of ejector-type contact heat exchanger 43-44 by way of pump discharge line 39 and check valve 42.

Ejector-type contact heat exchanger 43-44 is internally disposed within steam space 45 of boiler member 29, and is comprised of central motive-nozzle member 43 and annular secondary-nozzle member 44. Ejector heat exchanger 43-44 is actuated by pressurized recirculated boiler water supplied from circulating pump 38. In operation the high-velocity water jet from motive nozzle 43 creates a low-pressure zone across the throat of secondary-nozzle member 44, causing the entrainment of saturated heating steam from steam space 45 of boiler member 29. The mixture of boiler water and steam flows from the outlet of secondary-nozzle member 44 into passageways of splash distribution channel 46, which separates steam and water flow internally within boiler member 29.

From the foregoing, it will be perceived by those skilled in the art that the present invention provides an effective means for maintaining bulk boiler water at or near the saturation temperature for the operating pressure.

While I have shown and described a specific embodiment of the present invention, it will be understood by those skilled in the art that the invention is not limited exactly thereto, since various modifications may be made without departing from the scope of the invention as defined in the appended claims.

Forced Circulation Steam Generator

Nomenclature of FIG. 1

11 Steam generator or boiler member
12 Boiler steam outlet
13 Main steam header
14 Steam valve
15 Boiler feed or return line
16 Check valve
17 Circulating heat exchanger steam supply branch
18 Steam throttle valve
19 Contact heat exchanger
20 Boiler circulating line
21 Valve
22 Eductor
23 Circulating pump
24 Pump discharge line
25 Eductor nozzle supply branch
26 Throttle valve
27 Circulating heat exchanger discharge line
28 Check valve

Nomenclature of FIG. 2

29 Steam generator or boiler member
30 Boiler steam outlet
31 Main steam header
32 Steam valve
33 Boiler feed or return line
34 Check valve
35 Boiler circulating line
36 Valve
37 Eductor
38 Circulating pump
39 Pump discharge line
40 Eductor nozzle supply branch
41 Throttle valve
42 Check valve
43 Ejector motive nozzle (internal to boiler)
44 Open secondary nozzle (internal to boiler)

45 Boiler steam space
46 Ejector splash distribution channel (internal to boiler)

I claim:

1. Forced circulation steam generating apparatus comprising in combination; a steam generator or boiler member having integral heating processes; a circulating liquid pump; a water-jet ejector-type contact heat exchanger which provides a motive-nozzle supply inlet, a receiver-side steam suction inlet, and a discharge outlet therefrom; communicating means between the water body of said steam generator member and the inlet of said circulating pump; discharge conduit communicating between the outlet of said circulating pump and the motive-nozzle inlet of said ejector heat exchanger; means for transferring heating steam generated by said steam generator or boiler member into the suction inlet of said ejector heat exchanger; and communicating means between the discharge outlet of said ejector heat exchanger and the water body of said steam generator member.

2. Forced circulation steam generating apparatus comprising in combination; a steam generator or boiler member having integral heating processes; a circulating liquid pump; a water-jet ejector-type contact heat exchanger which provides a motive-nozzle supply inlet, a receiver-side steam suction inlet, and a discharge outlet therefrom; communicating means between the water body of said steam generator member and the inlet of said circulating pump; discharge conduit communicating between the outlet of said circulating pump and the motive-nozzle inlet of said ejector heat exchanger; communicating means between the supply of heating steam generated by said steam generator or boiler member and the suction inlet of said ejector heat exchanger; and communicating means between the discharge outlet of said ejector heat exchanger and the water body of said steam generator member.

3. The forced circulation steam generating apparatus of claim 2 wherein the ejector heat exchanger is disposed exterior to the said steam generator member.

4. The forced circulation steam generating apparatus of claim 2 wherein steam supply conduit communicates between the suction inlet of said ejector heat exchanger and a heating steam outlet supplied from said steam generator member.

5. The forced circulation steam generating apparatus of claim 2 wherein steam supply conduit communicates between the suction inlet of said ejector heat exchanger and a heating steam outlet supplied from said steam generator member; and valve throttling means disposed in the said steam supply conduit.

6. The forced circulation steam generating apparatus of claim 2 wherein the ejector heat exchanger is disposed internally within said steam generator member.

7. The forced circulation steam generating apparatus of claim 2 wherein the ejector heat exchanger is disposed internally within said steam generator member, and discharges a mixture of recirculated boiler water and heating steam thereinto.

* * * * *